US005394896A

United States Patent [19]

Wilk

[11] Patent Number: 5,394,896

[45] Date of Patent: * Mar. 7, 1995

[54] UMBRELLA WITH ROUNDED RIB TERMINALS

[76] Inventor: Peter J. Wilk, 185 West End Ave., New York, N.Y. 10023

[ * ] Notice: The portion of the term of this patent subsequent to Apr. 26, 2011 has been disclaimed.

[21] Appl. No.: 233,307

[22] Filed: Apr. 26, 1994

Related U.S. Application Data

[62] Division of Ser. No. 49,134, Apr. 19, 1993, Pat. No. 5,305,771.

[51] Int. Cl.[6] ..... A45B 25/00

[52] U.S. Cl. ..... 135/31; 135/33.2

[58] Field of Search ..... 135/27, 33.4, 31, 33.2, 135/33.41, 33.5, 44

[56] References Cited

U.S. PATENT DOCUMENTS

| | | | |
|---|---|---|---|
| 628,006 | 7/1899 | Hofrichter | 135/33.41 |
| 989,416 | 4/1911 | Raber et al. | 135/33.41 |
| 1,431,775 | 10/1922 | Cannon, Jr. et al. | 135/33.4 |
| 1,693,536 | 11/1928 | Woodley | 135/33.41 |
| 2,531,735 | 11/1950 | Jones | 135/33.41 |
| 4,061,154 | 12/1977 | Cox et al. | 135/33.41 |
| 4,084,600 | 4/1978 | dePolo | 135/33.4 X |
| 5,226,438 | 7/1993 | Dubinsky . | |
| 5,305,771 | 4/1994 | Wilk . | |

FOREIGN PATENT DOCUMENTS

| | | | |
|---|---|---|---|
| 2977 | of 1863 | United Kingdom | 135/27 |
| 1626 | of 1881 | United Kingdom | 135/33.41 |

*Primary Examiner*—Lanna Mai

*Attorney, Agent, or Firm*—R. Neil Sudol; Henry D. Coleman

[57] ABSTRACT

An umbrella has an elongate shaft, a web member, and a foldable support linkage for enabling an opening of the umbrella from a collapsed storage configuration to an opened use configuration and for supporting the web in the opened configuration of the umbrella. The foldable linkage is connected to the shaft and to the web member and has a plurality of radially extending ribs angled with respect to each other. The foldable linkage also includes a plurality of elongate flexible tie members each connected at opposite ends to free ends of adjacent ones of the ribs. The tie members have central arcuate portions which are inserted into an annular pocket formed at the periphery of the web by an inwardly turned flange. The flange is stitched or otherwise connected to a main body of the web member at circumferentially spaced locations on concave sides of the central arcuate portions.

5 Claims, 2 Drawing Sheets

UMBRELLA WITH ROUNDED RIB TERMINALS

This application is a continuation of application Ser. No. 08/049,134, filed Apr. 19, 1993, now U.S. Pat. No. 5,305,771.

BACKGROUND OF THE INVENTION

This invention relates to an umbrella.

Umbrellas all have a flexible web or sheet member which is held up by a foldable linkage movably connected to a shaft or handle. In many designs, the ribs are inserted, at their radially outer ends, into small cup-shaped collars which in turn are attached to the web. During use the ribs invariably slide out from the cup-shaped holders or connectors. Although the ribs can be easily reinserted into those connectors, the ribs continue to fall out, which results in an unending inconvenience for the user.

OBJECTS OF THE INVENTION

An object of the present invention is to provide an umbrella design which is improved over the above-described conventional construction.

Another object of the present invention is to provide an umbrella in which the attachment of the ribs to the web, particularly at the outer ends of the ribs, is more secure and more durable.

These and other objects of the present invention will be apparent from the drawings and detailed descriptions herein.

SUMMARY OF THE INVENTION

An umbrella comprises, in accordance with the present invention, an elongate shaft, a web member, and a foldable support linkage for enabling an opening of the umbrella from a collapsed storage configuration to an opened use configuration and for supporting the web in the opened configuration of the umbrella. The foldable linkage is connected to the shaft and to the web member and has a plurality of radially extending ribs angled with respect to each other. The foldable linkage also includes a plurality of elongate flexible tie members each connected at opposite ends to free ends of adjacent ones of the ribs. The tie members have central arcuate portions along which the tie members are coupled to the web member.

According to a more specific feature of the present invention, adjacent ribs define respective planes in the opened configuration of the umbrella, while the tie members lie essentially in the planes defined by the respective pairs of tie members in the opened configuration of the umbrella.

Pursuant to an alternative view of this feature of the invention, the tie members together take the form of a downwardly depending scalloped shape in an upright opened configuration of the umbrella.

Pursuant to another feature of the present invention, the web member is provided along a periphery with a flange which is inwardly turned to form an annular pocket. The central arcuate portions of the tie members are inserted into the pocket, and the flange is stitched or otherwise connected to a main body of the web member at circumferentially spaced locations on concave sides of the central arcuate portions.

Pursuant to a further feature of the present invention, the tie members are made of a flexible polymeric material with a memory. Additionally, the tie members may be provided along the central portions with preformed bend points, thereby aiding a folding of the umbrella into a collapsed storage configuration.

An umbrellas comprises, in accordance with another conceptualization of the present invention, an elongate shaft, a web member provided along a periphery with a flange which is inwardly turned to form an annular pocket, and a foldable linkage for enabling an opening of the umbrella from a collapsed storage configuration to an opened use configuration and for supporting the web in the opened configuration of the umbrella. The foldable linkage is connected to the shaft and to the web member and has a plurality of radially extending ribs angled with respect to each other. The ribs have rounded terminals at ends of the ribs opposite the shaft, the rounded terminals being inserted into the pocket. Attachment elements are provided for fastening the flange to a main body of the web member at circumferentially spaced locations to secure the rounded terminals to the web.

Pursuant to another feature of the present invention, each of the ribs has a radial outward end connected to radially outer ends of two adjacent ribs via a pair of arcuate tie members, the tie members being the rounded terminals.

Pursuant to an alternative feature of the present invention, each of the ribs is provided with a respective rounded terminal on a respective radial extension.

In an umbrella in accordance with the present invention the ribs do not fall out of cup-shaped holders or connectors, for there are no such connectors. The ribs are rounded at their free ends, which is safer than conventional designs.

An umbrella in accordance with the present invention is resistant to inversion. Moreover, the ribs won't poke through and perforate the web.

DETAILED DESCRIPTION

Figure 1:
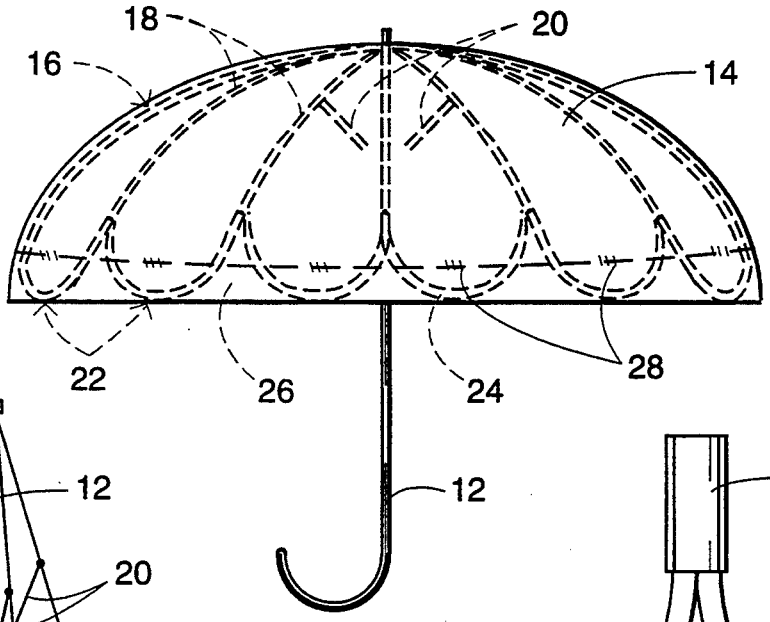
FIG. 1 is a schematic side elevational view of an umbrella in an opened, upright configuration, in accordance with the present invention.

As illustrated in FIG. 1, an umbrella comprises an elongate shaft 12, a web member 14, and a foldable articulated support linkage or frame 16. Support linkage 16 includes a plurality of radially extending ribs 18 which are in contact with umbrella web 14 at least in a peripheral region thereof. Ribs 18 extend in respective radial directions angled with respect to each other.

Figure 2:
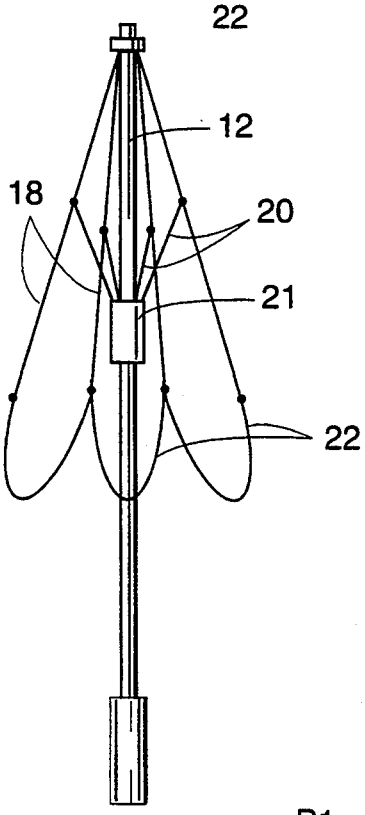
FIG. 2 is a diagram of support components of the umbrella of FIG. 1, showing the umbrella in a collapsed configuration.

Support linkage 16 further includes stretcher arms 20 and other members (not shown) which are pivotably connected to ribs 18 and to a runner 21 (FIG. 2) on shaft 12, in a conventional structure. Linkage 16 enables a user to open the umbrella from a collapsed storage configuration (FIG. 2) to an opened use configuration (FIG. 1) and supports web 14 in the opened configuration of the umbrella (as well as the closed or folded configuration).

Figure 3:
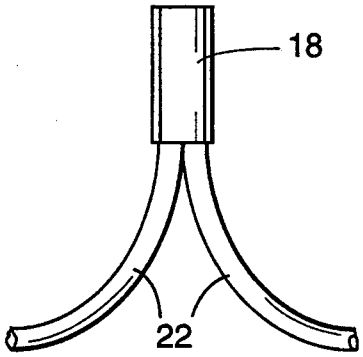
FIG. 3 is a schematic partial front elevational or top view of a rib and two tie elements in the frame of the umbrella of FIGS. 1 and 2.

Linkage 16 also includes a plurality of elongate flexible tie members 22 each connected at opposite ends to free ends of adjacent ribs 18. As illustrated in FIG. 3, each rib 18 is connected at its outer end (opposite shaft 12) to a pair of tie members 22 which arc in substantially opposing directions.

Tie members 22 have central arcuate portions 24 which are inserted into an annular pocket formed by an annular flange or flap 26 provided along the periphery of web 14. Flap 26 may be stitched or otherwise connected to the main body of web 14 at circumferentially spaced locations 28 on the concave sides of central arcuate portions 24 of tie members 22.

Figure 4:
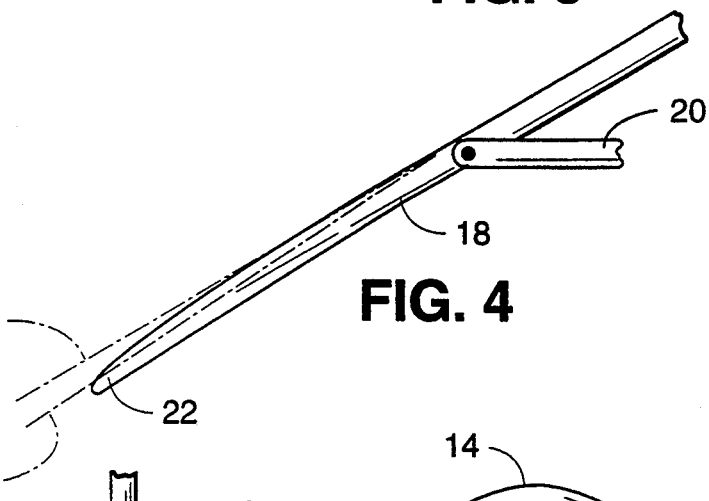
FIG. 4 is a schematic partial side elevational view of a rib and a tie element in the frame of the umbrella of FIGS. 1 and 2.

As depicted in FIG. 4, adjacent ribs 18, particularly radially outer portions thereof, define respective planes P1 in the opened configuration of the umbrella. Planes P1 are generally angled downwardly with respect to shaft 12 in the opened configuration of the umbrella. Tie members 22 lie in planes P2 essentially coplanar with planes P1.

Figure 5:
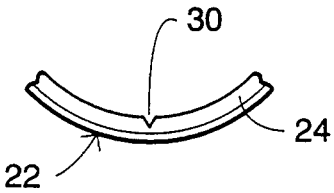
FIG. 5 a schematic partial elevational view of a tie member of an umbrella frame in accordance with the present invention, showing the tie member in an opened or extended configuration.
Figure 6:
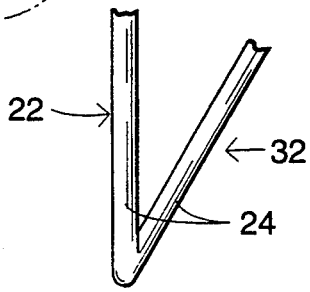
FIG. 6 is a schematic partial elevational view of another tie member of an umbrella frame in accordance with the present invention, showing the tie member in a closed or folded configuration.

As best illustrated in FIG. 1, tie members 22 together take the form of a downwardly depending scalloped shape in an upright opened configuration of the umbrella. Tie members 22 are preferably made of a flexible polymeric material with a memory. Additionally, tie members 22 may be provided along central arcuate portions 24 with preformed bend points implemented by cutouts or notches 30, as illustrated in FIG. 5. Bend points or cutouts 30 aid a folding of the umbrella into the collapsed storage configuration of FIG. 2. However, many polymeric materials (such as that commonly used to make contemporary drinking straws, Venetian blinds, flexible catheters, etc.) may elastically deform into a bent or angle configuration 32, as shown in FIG. 6, without requiring a notch or cutout 30 (FIG. 5).

Figure 7:
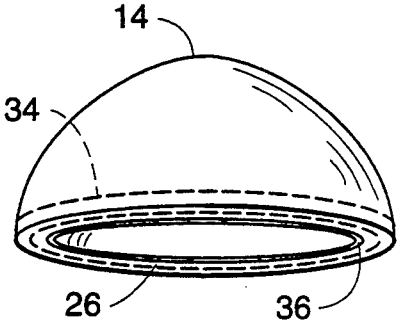
FIG. 7 is a schematic side elevational view of an umbrella web in accordance with the present invention.

As illustrated in FIG. 7, an umbrella web 14 may be provided along flange or flap 26 with a reinforcement strip 34 for facilitating the reception and transmission of forces carried by tie members 22. In addition, a deformable polymeric rod 36 may be connected to flap 26 along an edge thereof for reinforcing that edge.

Figure 8:
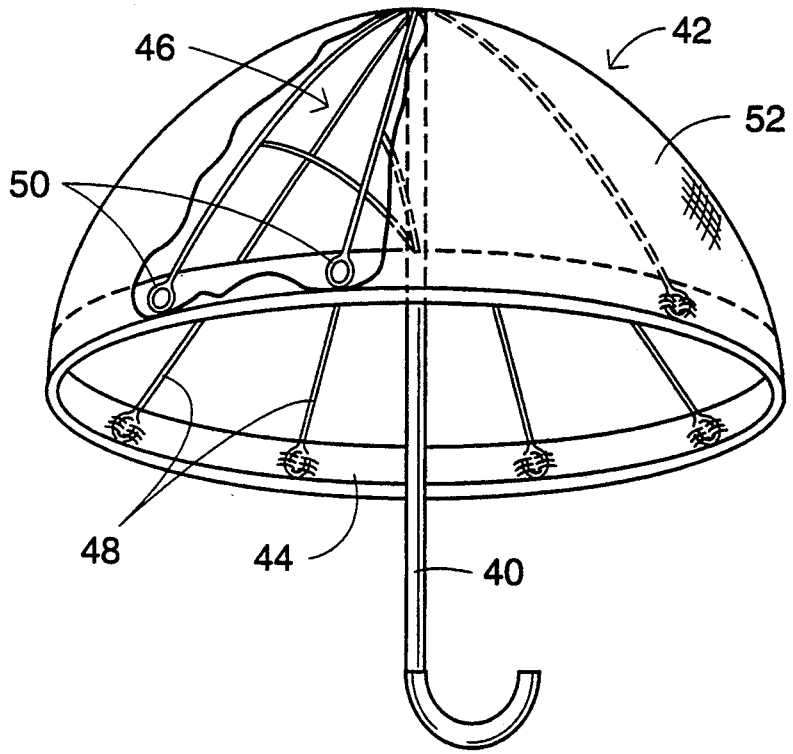
FIG. 8 is a schematic perspective view of another umbrella in an opened, upright configuration, in accordance with the present invention.
Figure 9:
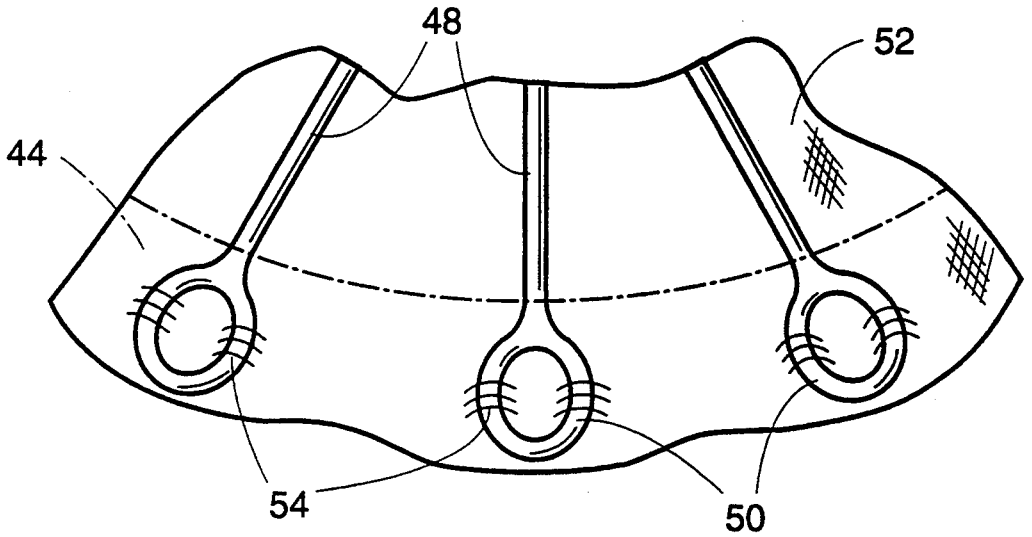
FIG. 9 is a partial bottom view of the umbrella of FIG. 8.

As illustrated in FIGS. 8 and 9, another umbrella comprises an elongate shaft 40 and a web member 42 provided along a periphery with a flange or flap 44 which is inwardly turned to form an annular pocket. An articulated linkage 46 is connected to shaft 40 and to web 14 for movably supporting the web on the shaft both in a collapsed storage configuration and an opened use configuration. Linkage 46 has a plurality of radially extending ribs 48 which are circumferentially spaced with respect to each other. Ribs 48 have rounded terminals or loops 50 at ends of the ribs opposite shaft 40. Terminals 50 are inserted into the pocket formed by flap 44. Flap 44 is attached or fastened to a main body 52 of web 42 at circumferentially spaced locations 54 to secure the outer ends of ribs 48 to web 42.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. An umbrella comprising:

an elongate shaft;

a web member;

support means for enabling an opening of the umbrella from a collapsed storage configuration to an opened use configuration and for supporting said web in the opened configuration of the umbrella, said support means including a foldable linkage connected to said shaft and to said web member and having a plurality of radially extending ribs angled with respect to each other, said ribs each having a free end, said support means also including a plurality of elongate flexible tie members each having opposite ends connected to free ends of adjacent ones of said ribs, said tie members having central portions provided with fold points; and attachment means for coupling said tie members to said web member along said central portions.

2. The umbrella defined in claim 1 wherein said adjacent ones of said ribs define respective planes in said opened configuration of the umbrella, said tie members lying substantially in said planes in said opened configuration.

3. The umbrella defined in claim 1 wherein said tie members together take the form of a downwardly depending scalloped shape in an upright opened configuration of the umbrella.

4. The umbrella defined in claim 1 wherein said central portions are arcuate, said web member being provided along a periphery with a flange which is inwardly turned to form an annular pocket, said central portions of said tie members being inserted into said pocket, said attachment means including means for fastening said flange to a main body of said web member at circumferentially spaced locations on concave sides of said central portions.

5. The umbrella defined in claim 1 wherein said tie members are made of a flexible polymeric material with a memory.

* * * * *